US006238484B1

(12) United States Patent
Hasegawa

(10) Patent No.: US 6,238,484 B1
(45) Date of Patent: May 29, 2001

(54) REACTIVE HOT-MELT ADHESIVE COATING MACHINE

(75) Inventor: Susumu Hasegawa, Tokyo (JP)

(73) Assignee: ITW Dynatec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/179,964

(22) Filed: Oct. 28, 1998

(30) Foreign Application Priority Data

Oct. 30, 1997 (JP) ..... 9-297994

(51) Int. Cl.[7] ..... B05B 15/02; B05B 7/00; B08B 9/00; B08B 9/02; B08B 9/027

(52) U.S. Cl. ..... 118/302; 118/24; 118/104; 239/112; 156/389; 156/578; 134/22.12; 134/22.14

(58) Field of Search ..... 118/302, 24, 312, 118/319, 104; 239/79, 70, 112; 156/389, 578; 134/22.18, 22.19, 22.12, 22.14, 167 R

(56) References Cited

U.S. PATENT DOCUMENTS 3,348,520 * 10/1967 Lockwood ..... 118/302
4,895,603 * 1/1990 Semp et al. ..... 134/21
5,720,850 * 2/1998 Otta ..... 239/112
5,964,407 * 10/1999 Sandkleiva ..... 239/112

FOREIGN PATENT DOCUMENTS 9-299865 11/1997 (JP) .

* cited by examiner

*Primary Examiner*—Richard Crispino
*Assistant Examiner*—J. A. Lorengo
(74) *Attorney, Agent, or Firm*—Lowe Hauptman; Gilman & Berner, LLP

(57) ABSTRACT

A reactive hot-melt adhesive coating machine capable of preventing a nozzle clogging by a simple construction is disclosed. A reactive hot-melt adhesive in a molten state supplied from an adhesive storage tank is fed to a spray means through an adhesive feeding passage. A cleaning fluid which is not curable reacting with moisture content in the ambient air is stored in a cleaning fluid storage tank. The cleaning fluid storage tank is connected to the adhesive feeding passage through a cleaning fluid feeding passage and a change-over valve. The change-over valve functions to disconnect the cleaning fluid feeding passage from the adhesive feeding passage when the reactive hot-melt adhesive is sprayed out of nozzles, and connect the cleaning fluid feeding passage to the adhesive feeding passage to discharge the cleaning fluid out of the nozzles when the nozzles are cleaned.

16 Claims, 2 Drawing Sheets

REACTIVE HOT-MELT ADHESIVE COATING MACHINE

BACKGROUND OF THE INVENTION

This invention relates to a hot-melt adhesive coating machine, and more particularly, to a reactive hot-melt adhesive coating machine which applies a reactive hot-melt adhesive sprayed out of nozzles unto an applied object. The reactive hot-melt adhesive used in this machine is molten in a heated condition and curable when reacting with moisture content in ambient air.

Conventional reactive hot-melt adhesive coating machines are constructed to spray a reactive hot-melt adhesive out of a plurality of nozzles of a plurality of spray means. The reactive hot-melt adhesive is supplied from an adhesive supply means having an adhesive storage tank, which stores the reactive hot-melt adhesive in a molten condition, through an adhesive feeding passage with an appropriately pressurized air. The reactive hot-melt adhesive coating machine as constructed above has a problem that, after a coating operation with the spray means spraying out the reactive hot-melt adhesive, the reactive adhesive remaining within the nozzles is cured as a result of reacting with moisture in the ambient air, and the cured adhesive causes nozzle clogging. To avoid nozzle clogging, a known preventive measure is to saturate the heads of the nozzles in water-free oil after operation.

However, this a preventive measure for avoiding nozzle clogging requires the structure of the reactive hot-melt adhesive coating machine to have an oil tank and therefore becomes complex. Also, removing the oil from the nozzles takes substantial time. Further, the conventional apparatus still has another problem that the cured reactive hot-melt adhesive accumulated in each operation clogs the nozzles, as after each operation during the period between the end of the operation and the nozzles are saturated in the oil, a little amount of the reactive hot-melt adhesive remained at the opening of the nozzles is cured as a result of reacting with moisture in the ambient air.

SUMMARY OF THE INVENTION

The present invention has been made in view of the foregoing disadvantages of the prior art.

Accordingly, it is an object of the present invention to provide a reactive hot-melt adhesive coating machine which is capable of preventing clogging of nozzles by a simple structure.

It is another object of the present invention to provide a reactive hot-melt adhesive coating machine which is capable of removing a factor of a nozzle clogging by discharging a reactive hot-melt adhesive out of the nozzles after a coating operation.

A reactive hot-melt adhesive coating machine in accordance with the present invention has one or more sprayers spraying a reactive hot-melt adhesive out of a plurality of nozzles. The reactive hot-melt adhesive is molten in a heated condition and moisture curable when reacting with water content in the ambient air. The apparatus is also provided with an adhesive storage tank for storage of the molten reactive hot-melt adhesive, which is supplied from the adhesive storage tank to the nozzles of the sprayers through an adhesive feeding passage. The machine also includes a cleaning fluid storage tank for storage of cleaning fluid, which does not react with the molten reactive hot-melt adhesive to cure the molten reactive hot-melt adhesive, and is not curable reacting with ambient air or moisture content in the ambient air at a normal temperature. A cleaning fluid feeding passage through which the cleaning fluid is fed from the cleaning fluid storage tank to the adhesive feeding passage is connected to the adhesive feeding passage through a change-over valve. The change-over valve allows the reactive hot-melt adhesive to flow to the nozzles through the adhesive feeding passage and prevents the cleaning fluid from being fed from the cleaning fluid feeding passage to the adhesive feeding passage when spraying the reactive hot-melt adhesive out of the nozzles; and prevents the reactive hot-melt adhesive from being fed to the nozzles through the adhesive feeding passage, by disconnecting the adhesive feeding passage, and allows the cleaning fluid discharged out of the nozzles when cleaning the nozzles.

With the reactive hot-melt adhesive coating machine as constructed above, the cleaning fluid feeding passage is provided as a ramification on the way of the adhesive feeding passage between the adhesive storage tank and the spray means through the change-over valve, and the cleaning fluid storage tank is connected to the cleaning fluid feeding passage. In finishing the coating operation of spraying the reactive hot-melt adhesive, the change-over valve functions to connect the cleaning fluid storage tank to the spray means to supply the cleaning fluid from the cleaning fluid storage tank to the sprayers, thereby the reactive hot-melt adhesive remaining in the adhesive feeding passage downstream of the change-over valve and within the sprayers is discharged out of the nozzles by the feeding pressure of the cleaning fluid. In this step of the operation, the reactive hot-melt adhesive remaining in the adhesive feeding passage downstream of the change-over valve and within the sprayers is replaced with the cleaning fluid which does not react with water or moisture content in the ambient air. As a result, a factor a causing nozzle clogging after operation is removed. In resuming the coating operation, the change-over valve functions to disconnect the cleaning fluid storage tank from the sprayers and alternatively connects the adhesive storage tank to the spray means to supply adhesive. The adhesive comes out of the nozzles of the sprayers when the operation of spraying is resumed.

As described above, the coating machine in accordance with the present invention is capable of preventing nozzle clogging by discharging the reactive hot-melt adhesive, which causes a nozzle jamming, out of the passages of the sprayers including the nozzles after operation, and replacing with the cleaning fluid, which is not curable when reacting with the ambient air or moisture content in the ambient air at a normal temperature.

In the coating machine in accordance with the present invention, the clogging of the nozzles can be prevented in a simple structure of the apparatus as the replacement of the reactive hotmelt adhesive in the passages of the sprayers including nozzles with the cleaning fluid can be made by a switching action of the change-over valve to changeover the adhesive storage tank to the cleaning fluid storage tank.

The sprayers is arranged to spray out the reactive hot-melt adhesive out of the nozzles with appropriately pressurized air, and the cleaning fluid supply means is arranged to feed the reactive hot-melt adhesive with appropriately pressurized air and also feed the cleaning fluid by appropriately pressurized air.

The change-over valve may be a three-way valve and the cleaning fluid may be a hot-melt adhesive including non-aqueous solution or a hot-melt adhesive made of synthetic rubber. The cleaning fluid adopting a hot-melt adhesive made of such materials as described above exhibits relatively high viscosity coefficient, so as that the reactive hot-melt adhesive may be extruded out of the nozzles completely.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

A reactive hot-melt adhesive coating machine according to the present invention will be described hereinafter with reference to the accompanying drawings.

Figure 1:
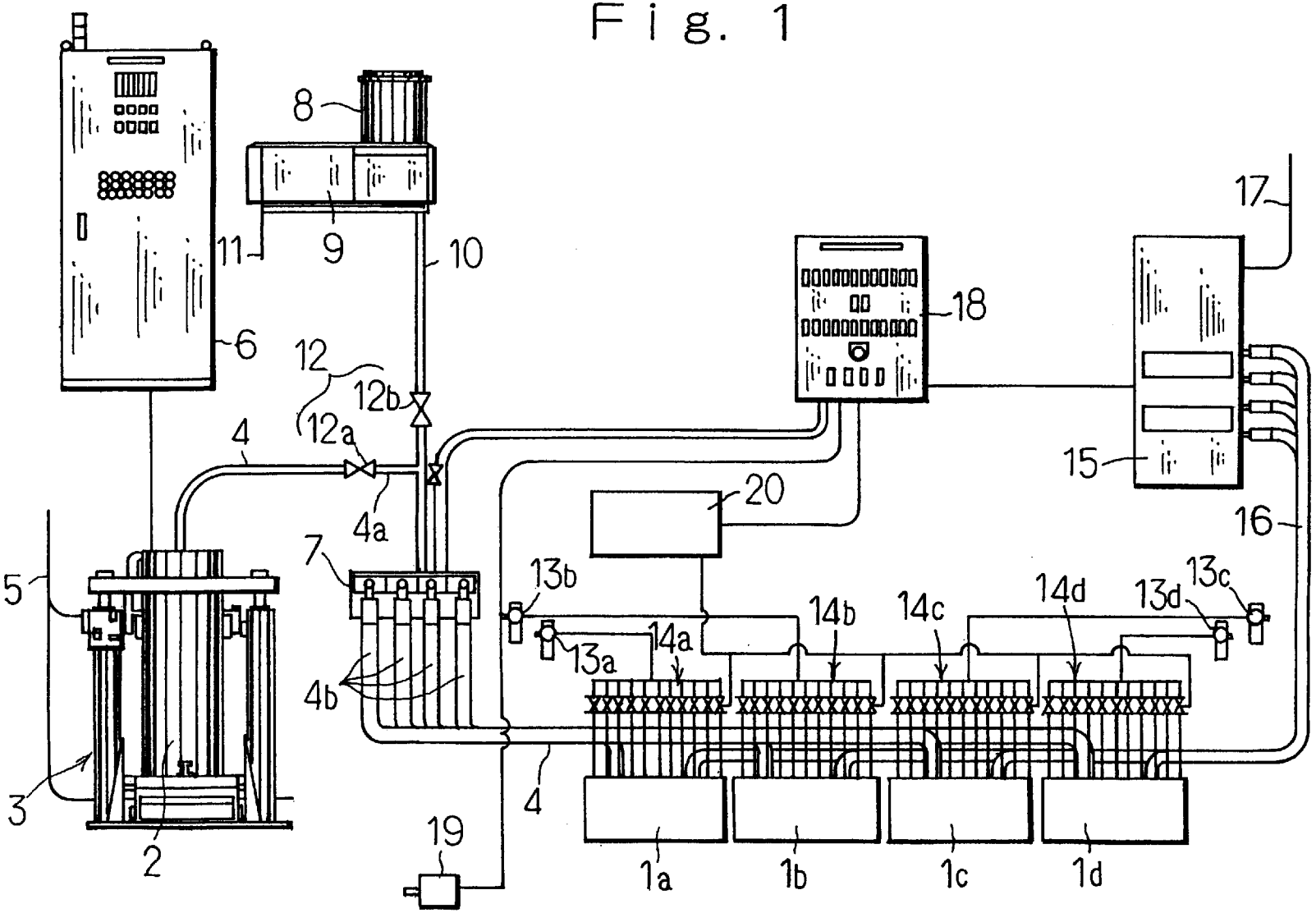
FIG. 1 is a schematic representation of a construction of an embodiment of a reactive hot-melt adhesive coating machine according to the present invention.

Referring to FIG. 1, an embodiment of a reactive hot-melt adhesive coating machine according to the present invention is illustrated. A reactive hot-melt adhesive coating machine of the illustrated embodiment includes a plurality of spray means 1*a* to 1*d* including a plurality of nozzles, out of which a reactive hot-melt adhesive is sprayed. The coating machine also includes an adhesive storage tank 2 for storage of the adhesive which is supplied to the spray means 1*a* to 1*d*. The reactive hot-melt adhesive used in this machine is molten in a heated condition and curable when reacting with moisture content in the ambient air. The adhesive storage tank 2, which is incorporated in an adhesive supply means 3, stores a molten reactive hot-melt adhesive to supply to each spray means 1*a* to 1*d* through an adhesive feeding passage 4 under a previously determined pressure. The adhesive feeding passage 4 includes a distributor 7, a passage 4*a* between the adhesive storage tank 2 and the distributor 7, and passages 4*b* between the distributor 7 and the spray means 1*a* to 1*d*. The adhesive supply means 3 includes a plunger pump for pumping out the reactive hot-melt adhesive and an air motor for driving the plunger pump. The air motor is connected to an air source (not shown) through a passage 5 for receiving air for driving the air motor. The adhesive supply means 3 is controlled by a control signal outputted from a control panel 6. The distributor 7 is provided to the passage 4*a* of the adhesive feeding passage 4 to distribute the reactive hot-melt adhesive supplied from the adhesive storage tank 2 to each spray means 1*a* to 1*d* through passages 4*b*. The adhesive feeding passage 4 branches out of the distributor 7 to reach each spray means 1*a* to 1*d*.

The reactive hot-melt adhesive coating machine of the illustrated embodiment further includes a cleaning fluid storage tank 8 for storage of a cleaning fluid which does not react with the reactive hot-melt adhesive to cure the molten reactive hot-melt adhesive, and the cleaning fluid is not curable when reacting with the ambient air or moisture content in the ambient air at a normal temperature. The cleaning fluid may be a hot-melt adhesive including a non-aqueous solution, for example, a hot-melt adhesive made of a synthetic rubber. The cleaning fluid storage tank 8 incorporated in a cleaning fluid supply means 9 stores the cleaning fluid which flows to each spray means 1*a* to 1*d* under a previously determined pressure through a cleaning fluid feeding passage 10 diverged from the adhesive feeding passage 4. An air source (not shown) is connected to the cleaning fluid supply means 9 through a pipe 11 for receiving air for driving.

The cleaning fluid feeding passage 10 which feeds the cleaning fluid from the cleaning fluid storage tank 8 to each spray means 1*a* to 1*d* is diverged from and connected to the adhesive feeding passage 4 through a change-over valve 12. The change-over valve 12 comprises a first valve 12*a* provided at the passage 4*a* connected to the adhesive storage tank 2, and a second valve 12*b* provided at the cleaning fluid feeding passage 10 connected to the cleaning fluid storage tank 8. The change-over valve 12 operates in such a manner that when spraying the reactive hot-melt adhesive out of nozzles of each spray means 1*a* to 1*d*, the first valve 12*a* is opened and the second valve 12*b* is closed to disconnect the cleaning fluid feeding passage 10 from the adhesive feeding passage 4; and when cleaning the nozzles of each spray means 1*a* to 1*d*, the first valve 12*a* is closed and the second valve 12*b* is opened to connect the cleaning fluid feeding passage 10 to the adhesive feeding passage 4 for discharging the cleaning fluid through the nozzles.

Figure 2:
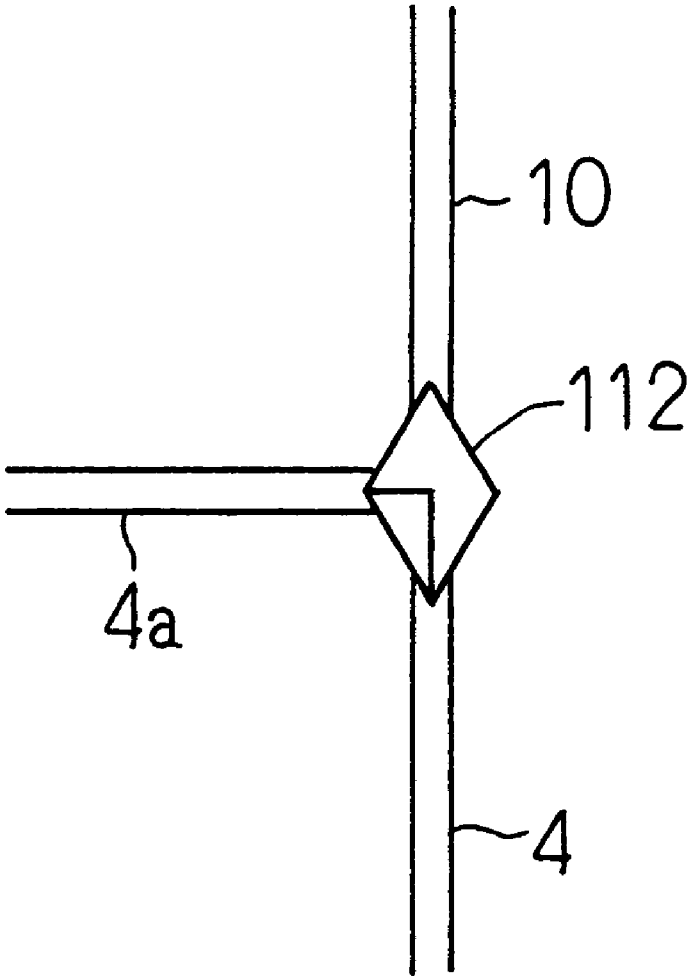
FIG. 2 is a fragmentary schematic view of an example of a change-over valve used in an embodiment of a reactive hot-melt adhesive coating machine according to the present invention.

The change-over valve may be a commonly known three-way valve 112 as shown in FIG. 2, two connection ports of which are connected to the passage 4*a* and one connection port of which is connected to the cleaning fluid feeding passage 10.

Each spray means 1*a* to 1*d* has a corresponding air source 13*a* to 13*d* from which air is supplied through each group of solenoid valves 14*a* to 14*d* corresponding to each spray means 1*a* to 1*d*, respectively. Spraying out of the nozzles is carried out under the pressure of the air supplied from each air source 13*a* to 13*d*. The spray means 1*a* to 1*d* are kept being heated by the heated air generated in a hot air generating apparatus 15 and supplied through four heating hoses 16. An air source (not shown) is connected to the hot air generating apparatus 15 through a pipe 17 for receiving air.

The distributor 7, the groups of solenoid valves 14*a* to 14*d* and the hot air generating apparatus 15 are controlled by a control panel 18 operated by an input signal from a tachometer generator 19 which detects a speed of a conveyer carrying adhesive applied objects. Between the control panel 18 and the groups of solenoid valves 14*a* to 14*d*, a pull box 20 is provided for wiring the solenoid valves.

In the reactive hot-melt adhesive coating machine as constructed above according to the present invention, the reactive hot-melt adhesive in a molten state stored in the adhesive storage tank 2 is supplied from the adhesive supply means 3 under a previously determined pressure and distributed by the distributor 7 to feed to each of spray means 1*a* to 1*d* through each passages 4*b*, respectively. The reactive hot-melt adhesive in a molten state is then sprayed out of the nozzles of each spray means 1*a* to 1*d* and applied on each object carried on the conveyer.

When the coating operation of the reactive hot-melt adhesive sprayed out of each spray means 1*a* to 1*d* is discontinued, the adhesive storage tank 2 is disconnected by switching the change-over valve 12, or closing the first valve 12*a* and opening the second valve 12*b*, and the cleaning fluid storage tank 8 is alternatively connected to the spray means 1*a* to 1*d* to feed the cleaning fluid from the cleaning fluid storage tank 8 to the spray means 1*a* to 1*d*. As a result, the reactive hot-melt adhesive remaining in the adhesive feeding passage 4 downstream of the change-over valve 12 and within the spray means is discharged out of the nozzles by the pressure of the cleaning fluid. The second valve 12*b* is then closed. The discharged substance is received by a receptacle which is not shown in the illustration. In this step of the operation, the adhesive feeding passage downstream of the change-over valve 12 and the spray means is filled with the cleaning fluid which does not react with moisture content in the ambient air, so that nozzle clogging caused after operation is avoided.

The coating operation is resumed first by switching the change-over valve 12, or keeping the second valve 12*b* closed and opening the first valve 12*a* to disconnect the cleaning fluid storage tank 8, and alternatively to connect the adhesive storage tank 2 to the spray means 1*a* to 1*d* for supplying the reactive hot-melt adhesive from the adhesive storage tank 2 to the spray means 1*a* to 1*d*. The reactive hot-melt adhesive comes out of the nozzles of the spray means, when the coating operation is resumed.

Thus, the nozzle clogging after operation is prevented as the reactive hot-melt adhesive which clogs up is removed from the passage of each spray means 1*a* to 1*d* including nozzles after the coating operation and replaced with the cleaning fluid which is not curable reacting with the ambient air or moisture content in the ambient air at a normal temperature. In the reactive hot-melt adhesive coating machine according to the present invention, the replacement of the reactive hot-melt adhesive in the passage of each spray means 1*a* to 1*d* including nozzles with the cleaning fluid can be done by an operation of the change-over valve 12 so that the clogging of the nozzles can be prevented by a simple structure of the machine.

The embodiment described herein has a plurality of spray means, however, the number of the spraying means can be only one. Also, the construction of the nozzles is optional that the nozzles may include a so-called T-die which discharges relatively large amount of adhesive and they are not limited to a type which sprays out the adhesive lineally or in a fine line.

The entire disclosure of Japanese Patent Application No. 297994/1997, filed on Oct. 30, 1997, including specification, claims, drawings and summary are incorporated herein by reference in its entirety.

What is claimed is:

1. A reactive hot-melt adhesive coating machine comprising, in combination:

at least one adhesive applicator for applying a reactive hot-melt adhesive, said reactive hot-melt adhesive being molten in a heated condition and curable when reacting with moisture in ambient air;

an adhesive storage tank for storing said reactive hot-melt adhesive in a molten state;

an adhesive feeding passage feeding said reactive hot-melt adhesive in a molten state from said adhesive storage tank to said at least one applicator;

a cleaning fluid and a cleaning fluid storage tank for storing said cleaning fluid which has a characteristic of not being reactive with said reactive hot-melt adhesive in a molten state to cure said reactive hot-melt adhesive and is not curable when reacting with ambient air or moisture in the ambient air at a normal temperature;

a cleaning fluid feeding passage connected to said adhesive feeding passage through a change-over valve for feeding said cleaning fluid from said cleaning fluid storage tank to said adhesive feeding passage; and said change-over valve having a first position for allowing said reactive hot-melt adhesive to be fed to said at least one applicator through said adhesive feeding passage while preventing said cleaning fluid from being fed from said cleaning fluid feeding passage to said adhesive feeding passage when issuing said reactive hot-melt adhesive out of said at least one applicator, and a second position for preventing said reactive hot-melt adhesive from being fed to said at least one sprayer through said adhesive feeding passage while allowing said cleaning fluid to be discharged out of said at least one when cleaning said at least one sprayer.

2. A reactive hot-melt adhesive coating machine as defined in claim 1, wherein said change-over valve is a three-way valve having two connecting ports respectively connected to said adhesive feeding passage and to said cleaning fluid feeding passage.

3. A reactive hot-melt adhesive coating machine as defined in claim 1, wherein said cleaning fluid is a synthetic rubber hot-melt adhesive.

4. A reactive hot-melt adhesive coating machine comprising, one or more applicators for applying a reactive hot-melt adhesive out of a plurality of nozzles, said reactive hot-melt adhesive being molten in a heated condition and curable when reacting with moisture content in the ambient air;

an adhesive supply for supplying said reactive hot-melt adhesive, including an adhesive storage tank storing said reactive hot-melt adhesive in a molten state;

an adhesive feeding passage feeding said reactive hot-melt adhesive in a molten state from said adhesive storage tank to said plurality of nozzles of said one or more applicators;

a cleaning fluid supply for supplying said cleaning fluid including a cleaning fluid storage tank storing cleaning fluid which does not react with said reactive hot-melt adhesive in a molten state to cure said reactive hot-melt adhesive and is not curable when reacting with ambient air or moisture in the ambient air;

a cleaning fluid feeding passage connected to said adhesive feeding passage through a change-over valve for feeding said cleaning fluid from said cleaning fluid storage tank to said plurality of nozzles through a part of said adhesive feeding passage; and said change-over valve disconnects said cleaning fluid feeding passage from said reactive hot-melt adhesive feeding passage when spraying said reactive hot-melt adhesive out of said plurality of nozzles, and interrupts the reactive hot-melt adhesive feeding passage and connects said cleaning fluid feeding passage to said reactive hot-melt feeding passage to discharge said cleaning fluid out of said plurality of nozzles when cleaning said plurality of nozzles.

5. A reactive hot-melt adhesive coating machine as defined in claim 4, further comprising said cleaning fluid as a hot-melt adhesive including a non-aqueous solution.

6. A reactive hot-melt adhesive coating machine as defined in claim 4, wherein said change-over valve is a three-way valve having two connecting ports respectively connected to said adhesive feeding passage and to said cleaning fluid feeding passage.

7. A reactive hot-melt adhesive coating machine as defined in claim 5, wherein said cleaning fluid is a synthetic rubber hot-melt adhesive.

8. A reactive hot-melt adhesive coating machine consisting essentially of, a plurality of sprayers for spraying a reactive hot-melt adhesive out of a plurality of nozzles by pressurized air, said reactive hot-melt adhesive being molten in a heated condition and curable when reacting with moisture in ambient air;

an adhesive supply for supplying said reactive hot-melt adhesive in a molten state by pressurized air including an adhesive storage tank storing said reactive hot-melt adhesive in a molten state;

an adhesive feeding passage feeding said reactive hot-melt adhesive in a molten state from said adhesive storage tank to said plurality of nozzles of said plurality of sprayers;

said adhesive feeding passage including a distributor provided in a passage between said adhesive storage tank and said distributor and a plurality of passages between said distributor and said plurality of sprayers;

a cleaning fluid supply for supplying a cleaning fluid by pressurized air including a cleaning fluid storage tank for storing the cleaning fluid which does not react with said reactive hot-melt adhesive in a molten state to cure said reactive hot-melt adhesive and is not curable when reacting with ambient air or moisture in the ambient air at a normal temperature;

a change-over valve provided in said passage between said adhesive storing tank and said distributor;

a cleaning fluid feeding passage connected to said adhesive feeding passage through said change-over valve for feeding said cleaning fluid from said cleaning fluid storage tank to said plurality of nozzles of said plurality of sprayers through a part of said adhesive feeding passage; and said change-over valve having a first position for allowing said reactive hot-melt adhesive to be fed to said plurality of nozzles through said adhesive feeding passage while preventing said cleaning fluid from being fed from said cleaning fluid feeding passage to said adhesive feeding passage when spraying said reactive hot-melt adhesive out of said plurality of nozzles, and a second position for preventing said reactive hot-melt adhesive from being fed to said plurality of nozzles through said adhesive feeding passage while allowing said cleaning fluid to be discharged out of said plurality of nozzles when cleaning said plurality of nozzles.

9. A reactive hot-melt adhesive coating machine as defined in claim 8, wherein said change-over valve is a three-way valve having two connecting ports respectively connected to said adhesive feeding passage and to said cleaning fluid feeding passage.

10. A reactive hot-melt adhesive coating machine as defined in claim 8, wherein said change-over valve includes a first valve which controls opening and closing of said adhesive feeding passage and a second valve which controls opening and closing of said cleaning fluid feeding passage.

11. A reactive hot-melt adhesive coating machine as defined in claim 8, further comprising said cleaning fluid as a hot-melt adhesive including a non-aqueous solution.

12. A reactive hot-melt adhesive coating machine as defined in claim 8, wherein said cleaning fluid is a synthetic rubber hot-melt adhesive.

13. A reactive hot-melt adhesive coating machine as defined in claim 11, wherein said plurality of sprayers are heated.

14. The coating machine of claim 1, wherein said cleaning fluid feeding passage is connected directly to said change-over valve.

15. The coating machine of claim 14, wherein said adhesive feeding passage is connected directly to said change-over valve.

16. A reactive hot-melt adhesive coating machine consisting essentially of:

at least one adhesive applicator for applying a reactive hot-melt adhesive, said reactive hot-melt adhesive being molten in a heated condition and curable when reacting with moisture in ambient air;

an adhesive storage tank for storing said reactive hot-melt adhesive in a molten state;

an adhesive feeding passage feeding said reactive hot-melt adhesive in a molten state from said adhesive storage tank to said at least one applicator;

a cleaning fluid storage tank for storing said cleaning fluid which has a characteristic of not being reactive with said reactive hot-melt adhesive in a molten state to cure said reactive hot-melt adhesive and is not curable when reacting with ambient air or moisture in the ambient air at a normal temperature;

a cleaning fluid feeding passage connected to said adhesive feeding passage through a change-over valve for feeding said cleaning fluid from said cleaning fluid storage tank to said adhesive feeding passage; and said change-over valve having a first position for allowing said reactive hot-melt adhesive to be fed to said at least one applicator through said adhesive feeding passage while preventing said cleaning fluid from being fed from said cleaning fluid feeding passage to said adhesive feeding passage when issuing said reactive hot-melt adhesive out of said at least one applicator, and a second position for preventing said reactive hot-melt adhesive from being fed to said at least one sprayer through said adhesive feeding passage while allowing said cleaning fluid to be discharged out of said at least one when cleaning said at least one sprayer.

* * * * *